US005693941A

United States Patent [19]

Barlow et al.

[11] Patent Number: 5,693,941

[45] Date of Patent: Dec. 2, 1997

[54] ASYMMETRIC ION TRAP

[75] Inventors: Stephan E. Barlow; Michael L. Alexander, both of Richland; James C. Follansbee, Pasco, all of Wash.

[73] Assignee: Battelle Memorial Institute, Richland, Wash.

[21] Appl. No.: 697,355

[22] Filed: Aug. 23, 1996

[51] Int. Cl.[6] ..... H01J 49/42

[52] U.S. Cl. ..... 250/292

[58] Field of Search ..... 250/292, 291, 250/290, 281, 282

[56] References Cited

U.S. PATENT DOCUMENTS

| | | | |
|---|---|---|---|
| 5,170,054 | 12/1992 | Franzen | 250/292 |
| 5,283,436 | 2/1994 | Wang | 250/292 |
| 5,298,746 | 3/1994 | Franzen et al. | 250/292 |
| 5,347,127 | 9/1994 | Franzen | 250/292 |
| 5,386,113 | 1/1995 | Franzen et al. | 250/292 |

OTHER PUBLICATIONS

Franzen, J., "Simulation Study of an Ion Cage with Superimposed Multipole Fields", International Journal of Mass Spectrometry and Ion Processes, 106 (1991) pp. 63–78.

Gabrielse, G., "Detection, Damping, and Translating the Center of the Axial Oscillation of a Charged Particle in a Penning Trap with Hyperbolic Electrodes", Physical Review A, vol. 29, No. 2, Feb. 1984, pp. 462–469.

March, R.E. and Hughes, R.J., "Quadrupole Storage Mass Spectrometry", Chemical Analysis, vol. 102, pp. 56–63.

*Primary Examiner*—Kiet T. Nguyen

*Attorney, Agent, or Firm*—Douglas E. McKinley, Jr.

[57] ABSTRACT

An ion trap having two end cap electrodes disposed asymmetrically about a center of a ring electrode. The inner surface of the end cap electrodes are conformed to an asymmetric pair of equipotential lines of the harmonic formed by the application of voltages to the electrodes. The asymmetry of the end cap electrodes allows ejection of charged species through the closer of the two electrodes which in turn allows for simultaneously detecting anions and cations expelled from the ion trap through the use of two detectors charged with opposite polarity.

5 Claims, 4 Drawing Sheets

ASYMMETRIC ION TRAP

This invention was made with Government support under Contract DE-AC06-76RLO 1830 awarded by the U.S. Department of Energy. The Government has certain rights in the invention.

FIELD OF THE INVENTION

The present invention relates generally to an apparatus and method for trapping ions or more specifically to an ion trap having end caps with different curvatures placed asymmetrically about a central ring electrode, thus allowing the expulsion of trapped ions in a preferred direction.

BACKGROUND OF THE INVENTION

Ion traps used to create essentially quadrupolar storage fields for trapping ions and other charged particles and consisting of ring and end cap electrodes have achieved broad use in applications such as mass spectrometers. In general, the performance of ion traps found in the prior art such as "Paul" type ion traps, which rely on RF fields to form trapping potentials, depend on trapping potentials which are as harmonic as possible. FIG. 1. shows a cut away view of the typical prior art ion trap arrangement of two end caps 2 and the ring electrode 4. Typically, the ring electrode and end caps of such ion trap devices are symmetrical or nearly symmetrical about a circumferential plane through the ring electrode. Ions are ejected through apertures 6 in the end caps 2 through a variety of methods known in the art such as secular excitation of the ions and movement of the ions past the RF instability boundary.

Under any of the methods employed for the ejection of ions from the trap, the translational energy of the ions must be raised to a level sufficient to allow the ions to overcome the confining forces created by the quadrupolar storage field. Thus, in the symmetric arrangements of ion traps known in the art, it is equally probable that ions will be ejected through either of the apertures 6 in the end caps 2 as the energy required to move the ions to the opposite position on either side of the symmetrical harmonic well is essentially equivalent. A detector 8 which is used to measure the mass spectrum of the ejected ions is typically located adjacent to only one of the apertures 6. Thus, it is typical that only a fraction of the ejected ions will be directed to the detector. Further, it is typical that the particular aperture through which the any of the ions are ejected is randomly determined. Thus, in many applications, this pattern for the ejection of ions results in mass spectrometric readings which are not consistent from reading to reading although the readings are taken from identical source material. Furthermore, this inconsistency in many cases is outside of the expected statistical fluctuations assuming random ejection of the ions. Thus, the probabilistic ejection of the ions out of either side of the ion trap introduces a source of noise, often unacceptably high, into the spectra produced by the ion trap mass spectrometer.

Those skilled in the art have addressed this problem by a variety of schemes. For example, it is typical that several readings of the mass spectrum of a given sample are produced by repeatedly introducing ions of the source material into the ion trap. These readings are then averaged to generate a composite spectra used to determine the characteristics of the materials. One disadvantage of this method is thus the time and effort resulting from taking and analyzing multiple readings. Also, this method assumes that the material introduced into the ion trap is consistent or homogenous from reading to reading and that the material is being ionized consistently from reading to reading. In many cases, it is apparent that one or both of these assumptions are flawed. For example, to achieve a mass spectrum for an aerosol, it is difficult if not impossible to insure that the composition of the aerosol will be consistent from one particle to the next. For this reason, it is desirable to have an ion trap which will eject all or nearly all of the ions of a given sample out one side of the ion trap in a predictable manner allowing the maximum possible amount of the sample to be directed to the detector.

Thus, there exists a need for a method or apparatus to allow the expulsion of ions trapped in an ion trap in a preferred direction.

SUMMARY OF THE INVENTION

According to the present invention, ion traps consisting of a ring electrode interposed between two hyperbolic end cap electrodes may be improved to allow the expulsion of ions in a preferred direction by locating the end caps asymmetrically about the plane defined by the ring electrode. In a preferred embodiment of the present invention, the interior surface of the end cap electrodes are made to conform with the equipotential lines of a harmonic potential well. To more fully describe the invention, a discussion of the prior art is useful. Typically, as depicted in FIG. 1, an ion trap consists of a ring electrode interposed between two hyperbolic end cap electrodes wherein the end cap electrodes are symmetrical or nearly symmetrical to one and another and are positioned symmetrically about the ring electrode. The end caps are described as symmetrical or nearly symmetrical because as practiced in the art, it is typical that the manufacturer strive to create symmetrical end caps, but due to limitations on the precision with which the end caps are machined or formed, it may be the case that the end caps are not perfectly symmetrical. In a typical arrangement, AC (RF) voltages are applied to the electrodes to create a (pseudo) potential well used to trap the ions. A number of equivalent ion trapping schemes are well known in the art, typical are those discussed in *Quadrupole Storage Mass Spectrometry,* RE March and RJ Hughes, Wiley, New York, 1989, Chapter 2, pp. 56–63. The electrodes may additionally have a DC bias voltage applied. In general, the potential well is described by the equation:

$$\Phi(r,\theta,z)=\frac{V}{D^2}\,(r^2-2z^2)+V\left(1-\frac{r_0^2}{D^2}\right)$$

Where V is an applied voltage, $r_o$ is the radius of the ring electrode at mid-plane, r, θ, and z are the cylindrical coordinates of the resultant electrical potential as measured from the center of the ring electrode, which is defined as the origin, and D is described by the equation:

$$D^2=\tfrac{1}{2}r_o^2+z_o^2$$

where $z_o$ is the distance from the origin to the nearest point of the end caps.

The choices of $r_o$ and $z_o$ are arbitrary and independent of one and another and may be chosen to suit the particular needs of the ion trap as it is operated. For example, in G. Gabrielse, *Phys. Rev. A,* Vol. 29, (1984) pg. 462, Gabrielse showed that careful consideration of the ratio $r_o/z_o$ led to the so called "orthogonalized trap". This is a trap where additional electrodes are used to correct and remove field errors due to truncation effects, without changing the harmonic frequency of the well.

FIG. 2 is a contour plot which shows the equipotential lines created by a pure quadrupolar ion trap. Each of the contours are hyperbolas whose asymptotes are given by the equation $$z=\frac{1}{\sqrt{2}}r$$

The present invention makes use of the observation that while creation of the harmonic potential necessary for trapping ions requires that the physical contours of each of the three electrodes correspond to one of the equipotential lines, the designer is free to select which equipotential line is selected. Thus, while the equipotential lines must maintain symmetry to allow harmonic potential, the same is not necessarily true for the components, particularly for the end caps. Thus, by selecting asymmetrical equipotential lines to define the contours of the end caps, the end caps may be designed to conform to these asymmetrical equipotential lines and still create a harmonic potential well suitable for the confinement of charged particles such as ions. This is illustrated by the heavy lines 10 in FIG. 2 which represent the contours of a typical arrangement of end cap and ring electrodes in an asymmetrical geometry which still preserves the harmonic potential well. Further, while the use of asymmetric end caps as the electrodes in this manner will create a harmonic potential well, the apertures in the end caps are not placed symmetrically within the harmonic potential well. Although the energy required to direct a charged particle to a point within the well is equivalent to the energy required to direct the same charged particle to the opposite point within the well, the energy required to direct charged particles to one aperture in an ion trap having asymmetric end caps will be different than the energy required to direct the same particle to the other aperture located a different distance from the center of the trapping potential. More specifically, it will take less .energy to direct a charged particle to the aperture that is closer to the center of the ring electrode, or the origin of the equipotential lines, hereafter referred to as the origin.

Thus, regardless of the mechanism used to direct charged particles contained within the potential well to an aperture, the charged particles will preferentially escape through the aperture closest to the origin. This is true even if the charged particles are excited or exposed to energy far in excess of that necessary to eject them from the aperture furthest from the origin, because prior to reaching that energy level or excitation state, the charged particles will be ejected through the other, or closer, aperture in the other, closer, end cap. Thus, the aperture in the end cap further from the origin is not necessary for ion ejection, and is thus not required as a feature of the ion trap. However, typically it would still be useful to have the aperture present in the end cap electrode furthest from the origin for some other reason apart from ion ejection, such as allowing the introduction of a test sample or the introduction of an ionization source to the ion trap.

A further advantage of the present invention accrues by virtue of the fact that under normal operating parameters, Paul type ion traps typically can store both positively and negatively charged species, i.e. anions and cations. Typical arrangements known in the art allow the ejection of one or the other of these oppositely charged species, with complete characterization requiring separate ejection and averaging over a series of scans for both positively and negatively charged species. By providing the end cap electrodes as asymmetrical, these oppositely charged species may be simultaneously ejected from the trap. As illustrated in FIG. 3, the placement of two detectors 12 then allows the simultaneous detection of both positively and negatively charged species exiting the trap through an aperture 14 in the center of the end cap electrode 16 nearest the origin. The ring electrode 18 and end cap electrode 20 furthest from the origin are shown to denote the relative position of the detectors 12 to the remainder of the trap. Detectors 12 suitable for use in conventional ion trap geometries are suitable for use in this embodiment and are well known to those skilled in the art. By providing different biasing or charge on the two detectors 12, for example providing a positive charge on one detector and a negative charge on the other detector, the oppositely charged particles are then preferentially directed to one detector or the other depending on the charge of the particle.

Thus, the choice of the dual detector mounting orientation and biasing produces additional benefits. First, ions whether ejected by instabilities, assisted instability or by secular resonance, tend to leave the trap with a wide energy dispersion. By angling the detectors 12 away from the line of particle ejection, the detectors provide a "time of flight" type energy focusing, i.e. ions leaving the trap simultaneously but with different energies will arrive at the detector 12 with a much smaller time distribution than would be the case with a detector mounted normal to the line of ejection. A second advantage that accrues with this design is the detectors 12 do not occlude access to the ion trap through the aperture 14 in the end cap 16.

It should be noted that the present invention is not limited to those embodiments which require the end cap electrodes and ring electrode to conform to the equipotential lines of a harmonic well. For example, ion traps which utilize higher order terms, or superimposed multipole fields, have been discussed in detail in U.S. Pat. No. 5,298,746, METHOD AND DEVICE FOR CONTROL OF THE EXCITATION VOLTAGE FOR ION EJECTION FROM ION TRAP MASS SPECTROMETERS, incorporated herein by reference, and in the *International Journal of Mass Spectroscopy Ion Processes,* J. Franzen, V. 106 pp. 63–78 (1991) also incorporated herein by reference. In these references, the sharpening of resonance lines through the addition of octopole and hexapole terms to the trapping potential is discussed. In particular, the addition of, a hexapole term, which requires the breaking of the internal plane of symmetry of the end cap electrodes and the ring electrode, produces an axial asymmetry (see Fransen, FIG. 11). The axial asymmetry produces preferential axial ion ejection through the introduction of highest order terms. However, as the higher order terms become large, the utility of the trap as a mass spectrometer diminishes as the ability to separate ions according to m/z is lost. The use of such higher order terms necessitates careful control of the RF fields.

While the end cap electrodes are modified from a hyperbolic form, they maintain a radial shape, and thus have radial centers, and are still disposed about a center ring electrode, as is the case with the more conventional geometry. The placement of the radial centers of such end cap electrodes at asymmetrical distances from the point defined as the center of the ring electrode thus achieves both the advantages of the present invention as well as the advantages gained by the use of non-hyperbolic forms for the electrodes.

OBJECTS

It is therefore an object of the invention in one of its embodiments to provide an ion trap having two end cap electrodes, where at least one of the end caps has an aperture and both end caps are disposed about a ring electrode, wherein the ion trap preferentially ejects charged particles through an aperture in the end cap closer to the center of the ring electrode.

It is further an object of the present invention to provide two end cap electrodes having radial centers disposed about a center ring electrode at different distances from a point defined as the center of the ring electrode in an ion trap.

It is further an object of the present invention to define the contours of end cap electrodes in an ion trap by the contours of asymmetrical equipotential lines created by the ion trap.

It is further an object of the present invention to provide two detectors to allow simultaneous detection of oppositely charged species ejected from the ion trap.

It is further an object of the present invention to provide opposite charge on the two detectors to preferentially direct oppositely charged species ejected from the ion trap to separate detectors.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1:
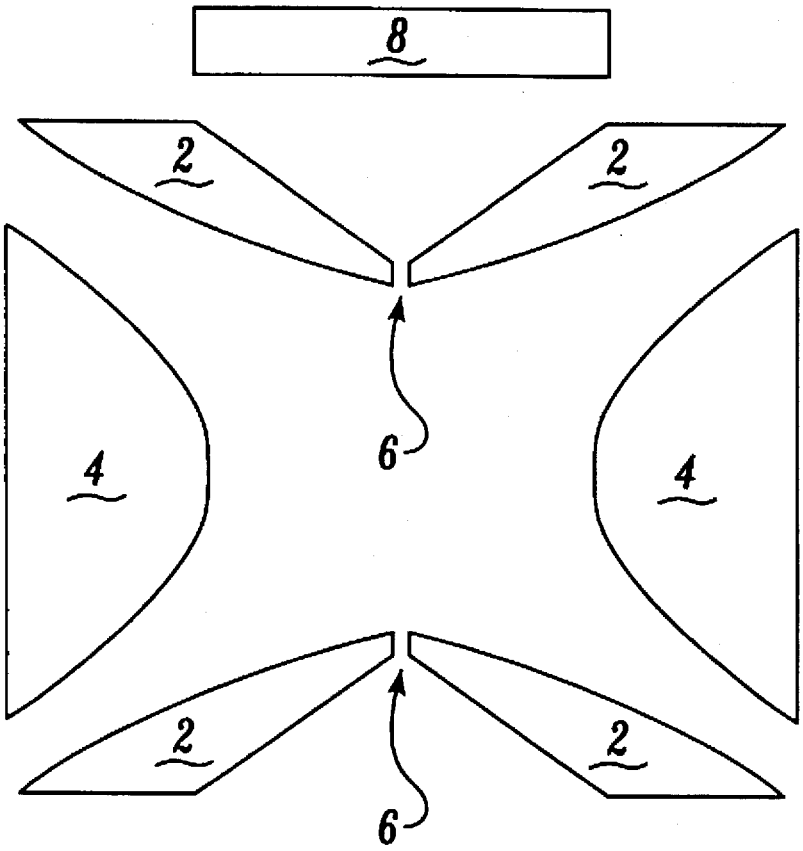
Fig. 1 (PRIOR ART)
FIG. 1 is a cut away schematic drawing of prior art ion traps.
Figure 2:
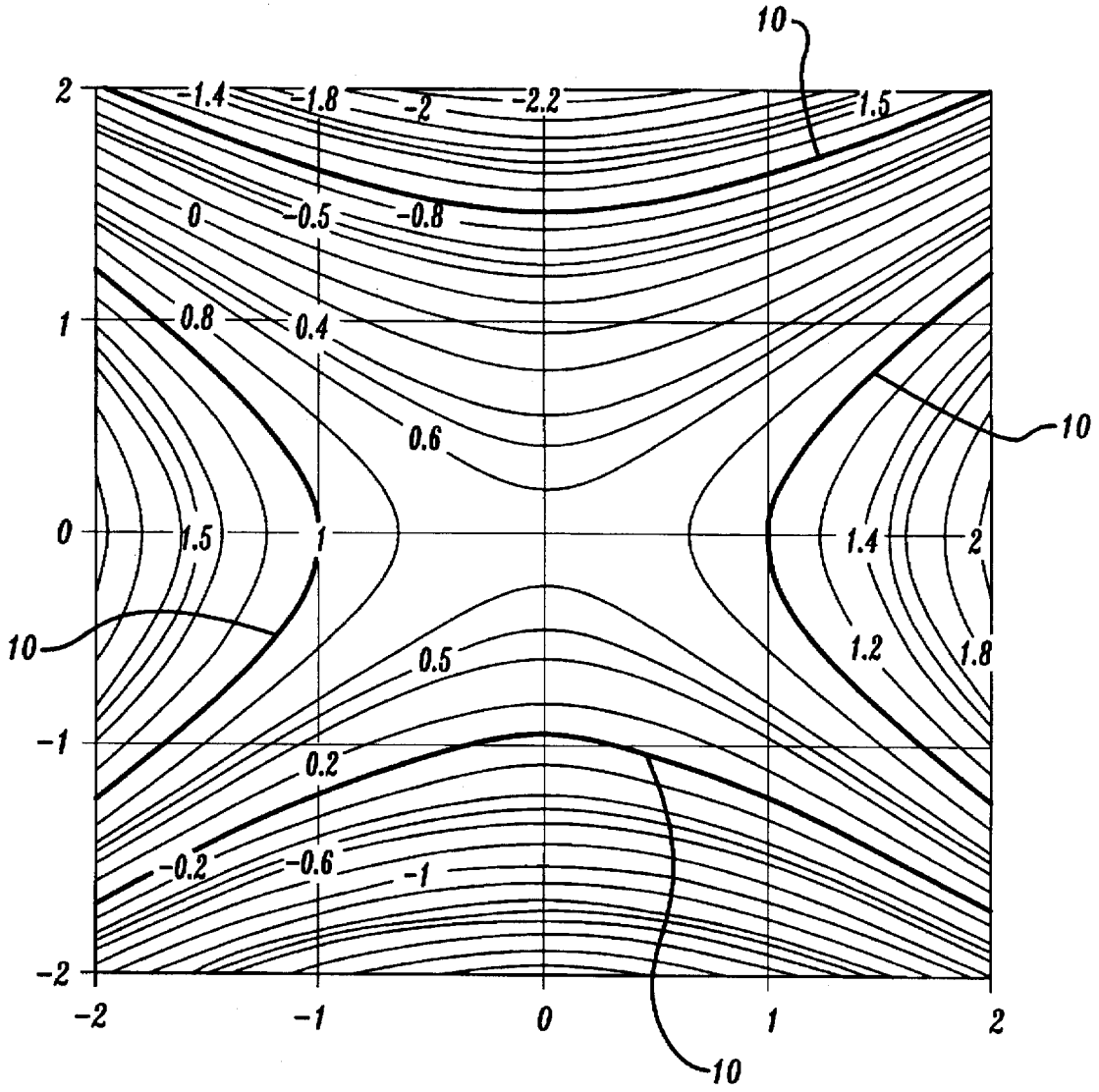
FIG. 2 is a contour plot which shows the equipotential lines created by an ion trap with darkened lines representing the contours of a typical arrangement of a ring electrode and asymmetrical end caps.
Figure 3:
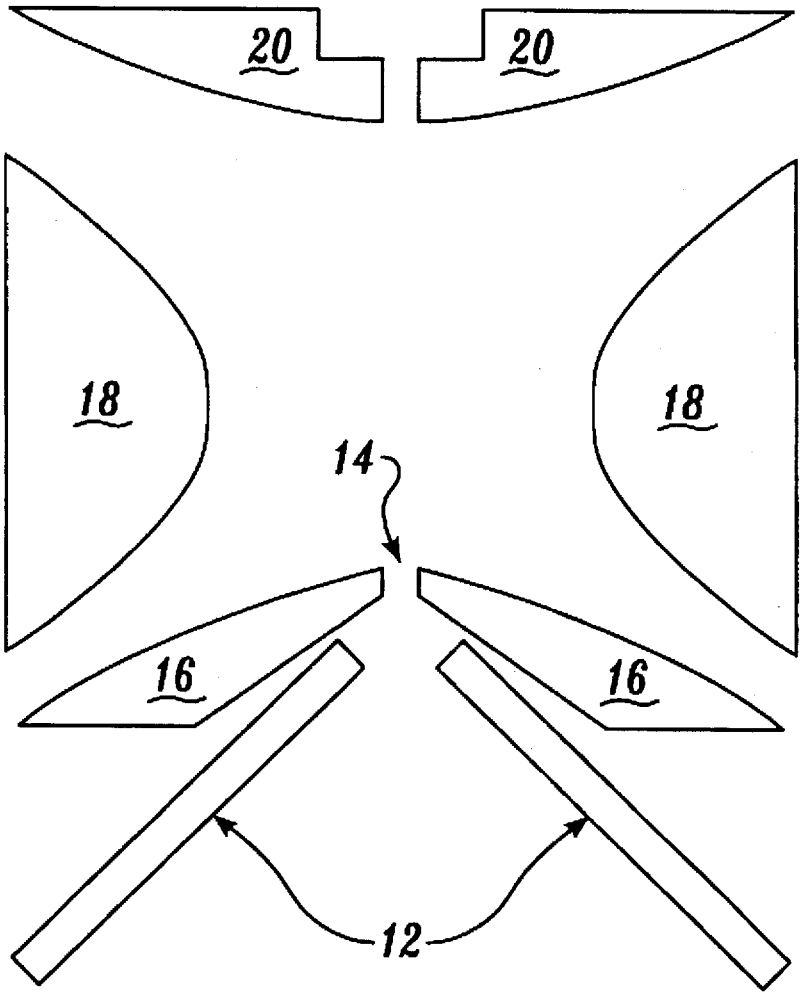
FIG. 3 is a cut away schematic drawing of the dual detector geometry.
Figure 4:
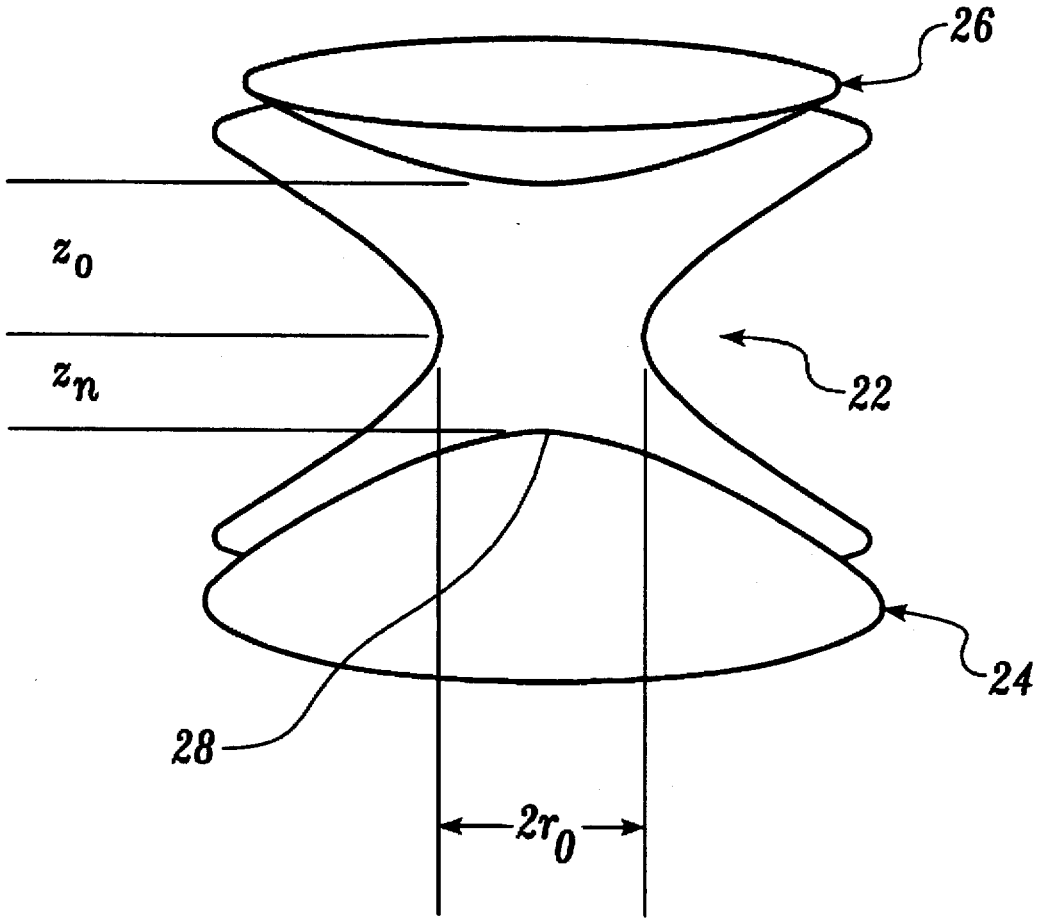
FIG. 4 is a three dimensional drawing of an asymmetrical ion trap.

In a preferred embodiment of the present invention, as illustrated in FIG. 4, two end cap electrodes having apertures at their centers are disposed about a center ring electrode 22, wherein the first end cap electrode 24 is positioned closer the center of the ring electrode than the second end cap electrode 26. Voltages are applied to the ring electrode 22 and the second end cap electrode 26. The applied voltages may be DC voltages, AC voltages or combinations of both. It is further preferred that the RF voltage applied to the second, further end cap electrode 26 is opposite, or 180 degrees out of phase with the RF voltage applied to the ring electrode 22. Of course, as required by Gauss's law, RF and DC offsets to the trapping potentials may be applied to all of the electrodes simultaneously without destroying the harmonic trapping well.

Similarly, in a DC arrangement, it is preferred that the potential applied to the second, further end cap electrode 26 be the negative of the potential applied to the ring electrode 22 and that the potential applied to the closer, first end cap electrode 24 be zero, or the average, of the voltages applied to the second, further end cap electrode 26 and the ring electrode 22. Again as will be apparent to those skilled in the art, these conditions merely describe the voltages placed on the various electrodes relative to one and another. Having established these conditions, the additional application of a second DC voltage or an AC voltage to each of the end cap electrodes and the ring electrode will not effect the voltages placed on each of the electrodes relative to one and another.

In this manner, an electrical field suitable for trapping charged particles is created which will have equipotential lines which may be described by the equation:

$$\Phi(r,\theta,z)=\frac{V}{D^2}\,(r^2-2z^2)+V\left(1-\frac{r_0^2}{D^2}\right)$$

Where V is the voltage applied to the second, further end cap electrode, $r_o$ is the radius of the ring electrode at mid-plane, r, θ, and z are the cylindrical coordinates of the resultant electrical potential as measured from the center of the ring electrode which is defined as the origin, and D is described by the equation:

$$D^2=\tfrac{1}{2}r_o^2+z_o^2\,.$$

where $z_o$ is the distance from the from the origin to the nearest point of the more distant end cap electrodes.

In the preferred embodiment, the interior surfaces of the end caps are made to conform as nearly as possible with the contours of the equipotential lines to create a symmetric harmonic potential well within the ion trap. Ions will preferentially be ejected through an aperture 28 at the center of the closer, first end cap electrode. Thus, while it is preferred that both of the end caps have apertures, it is not necessary that the second, further end cap electrode have an aperture to practice the present invention.

The difference in the distance between the location of the two end caps and the origin will determine the difference in the energy required to eject charged particles from each of the end cap electrodes. In the arrangement of the preferred embodiment, the ratio of the minimum energy required to cause charged particles to reach the apertures in the center of the end cap electrodes is described by the equation $E=z_o^2/z_n^2$ where $z_n$ is the distance from the closer, first end cap electrode to the origin and $z_o$ is the distance from the furthest, second end cap electrode. In the arrangement of the preferred embodiment, the relationship between $r_o$, where $r_o$ is the radius of the interior surface of the ring electrode, $z_o$ and $z_n$, is described by the equation $$z_n=\sqrt{z_o^2-\frac{1}{2}\,r_o^2}$$

While a preferred embodiment of the present invention has been shown and described, it will be apparent to those skilled in the art that many changes and modifications may be made without departing from the invention in its broader aspects. The appended claims are therefore intended to dover all such changes and modifications as fall within the true spirit and scope of the invention.

We claim:

1. An ion trap comprising a ring electrode and two end cap electrodes having radial centers disposed about a center of said ring electrode, wherein the radial centers of said end cap electrodes are placed at different distances from the center of the ring electrode.

2. The ion trap of claim 1 further comprising two detectors for simultaneously detecting anions and cations expelled from said ion trap.

3. An ion trap comprising a ring electrode; two end cap electrodes disposed about a center of said ring electrode; and a harmonic potential well having equipotential lines formed by the application of voltages to said ring and end cap electrodes; wherein the end cap electrodes are placed asymmetrical about the center of said ring electrode.

4. The ion trap of claim 3 further comprising an inner surface of each of said end cap electrodes conformed with an asymmetric pair of said equipotential lines.

5. The ion trap of claim 3 further comprising two detectors for simultaneously detecting anions and cations expelled from said ion trap.

* * * * *

UNITED STATES PATENT AND TRADEMARK OFFICE

CERTIFICATE OF CORRECTION

PATENT NO. : 5,693,941
DATED : 12/2/97
INVENTOR(S) : Stephan E. Barlow; Michael L. Alexander; James C. Follansbee.

It is certified that error appears in the above-identified patent and that said Letters Patent is hereby corrected as shown below:

In column 2, line 55, please change "$D^2=\frac{1}{2}r_o^2 z_o^2$" to --$D^2=\frac{1}{2}r_o^2 + z_o^2$--.

Signed and Sealed this

Twenty-sixth Day of January, 1999

*Attest:*

*Attesting Officer*

*Acting Commissioner of Patents and Trademarks*